US005743820A

United States Patent [19]

Espinosa et al.

[11] Patent Number: 5,743,820

[45] Date of Patent: Apr. 28, 1998

[54] BATTING PRACTICE DEVICE WITH ADJUSTABLE MOUNTING MEANS

[76] Inventors: Eugene R. Espinosa; Richard E. Espinosa, both of 442 Andrea Dr., Vacaville, Calif. 95687

[21] Appl. No.: 798,999

[22] Filed: Feb. 7, 1997

[51] Int. Cl.[6] ..... A63B 69/00

[52] U.S. Cl. ..... 473/429

[58] Field of Search ..... 473/423, 424, 473/427, 429, 430

[56] References Cited

U.S. PATENT DOCUMENTS

| | | | |
|---|---|---|---|
| D. 312,857 | 12/1990 | Montelongo | D21/210 |
| 2,929,632 | 3/1960 | Moffatt | 473/430 X |
| 2,976,040 | 3/1961 | Bales | 473/429 |
| 3,006,647 | 10/1961 | Haskett | 473/429 |
| 3,907,287 | 9/1975 | Fox et al. | 473/424 |
| 4,577,864 | 3/1986 | Aldrich | 473/424 |
| 4,793,612 | 12/1988 | Hammond | 473/429 |
| 4,881,742 | 11/1989 | Hargreave | 473/430 X |
| 5,246,226 | 9/1993 | McGuinn | 473/429 |
| 5,271,618 | 12/1993 | Malwitz | 473/429 |
| 5,433,435 | 7/1995 | Bourie | 473/424 |

*Primary Examiner*—William H. Grieb

[57] ABSTRACT

A batting practice device with adjustable mounting means comprises a support pole having an inboard end including mounting devices and an outboard end including a swivel joint; the swivel joint comprising a plurality of swivel hooks with a projection member, an eye screw and a central swivel member, the eye screw having a first end formed in a generally circular configuration and a second end formed as a screw, the second end being coupled to the outboard end of the support pole, the first swivel hook being positioned within the first end of the eye screw with its projection member coupled to the central swivel member, the projection member of the second swivel hook being coupled to the central swivel member; and a ball, a rope being coupled to the ball and secured to the second swivel hook of the swivel device.

7 Claims, 3 Drawing Sheets

BATTING PRACTICE DEVICE WITH ADJUSTABLE MOUNTING MEANS

BACKGROUND OF THE INVENTION

1. Field of the Invention

The present invention relates to a batting practice device with adjustable mounting means and more particularly pertains to mounting the device at a convenient location in a user's home to practice batting skills.

2. Description of the Prior Art

The use of batting devices is known in the prior art. More specifically, batting devices heretofore devised and utilized for the purpose of practicing batting skills are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,577,864 to Aldrich discloses a batting aid.

U.S. Pat. No. 5,271,618 to Malwitz discloses a batting practice device.

U.S. Pat. No. 5,433,435 to Bourie discloses a batter timing practice apparatus.

U.S. Pat. No. 5,246,226 to McGuinn discloses a tethered ball batting practice apparatus.

U.S. Pat. No. 3,907,287 to Fox et al discloses a tethered ball batting practice device.

U.S. Pat. No. Des. 312,857 to Montelongo discloses a tethered batting practice aid.

While these devices fulfill their respective, particular objective and requirements, the aforementioned patents do not describe a batting practice device with adjustable mounting means for mounting the device at a convenient location in a user's home to practice batting skills.

In this respect, the batting practice device with adjustable mounting means according to the present invention substantially departs from the conventional concepts and designs of the prior art, and in doing so provides an apparatus primarily developed for the purpose of mounting the device at a convenient location in a user's home to practice batting skills.

Therefore, it can be appreciated that there exists a continuing need for new and improved batting practice device with adjustable mounting means which can be used for mounting the device at a convenient location in a user's home to practice batting skills. In this regard, the present invention substantially fulfills this need.

SUMMARY OF THE INVENTION

In the view of the foregoing disadvantages inherent in the known types of batting devices now present in the prior art, the present invention provides an improved batting practice device with adjustable mounting means. As such, the general purpose of the present invention, which will be described subsequently in greater detail, is to provide a new and improved batting practice device with adjustable mounting means and method which has all the advantages of the prior art and none of the disadvantages.

To attain this, the present invention essentially comprises a new and improved batting practice device with adjustable mounting means comprising, in combination: a support pole being fabricated of plastic and formed in an elongated cylindrical configuration, the support pole having an inboard end including mounting means and an outboard end including a swivel joint, the mounting means comprising two adjustable U-clamps each formed in a generally semi-circular configuration with two arm members formed as screws, each U-clamp including a securing member coupled to the arm members by nuts, the U-clamps being positioned around the outboard end of the support pole, in an operative orientation a user suspending the support pole from a ceiling with the U-clamps; the swivel joint being fabricated of metal and comprising first and second generally circular swivel hooks, an eye screw and a central swivel member, the eye screw having a first end formed in a generally circular configuration and a second end formed as a screw, the second end being coupled to the outboard end of the support pole, each swivel hook being formed in a generally circular configuration with a projection member, the first swivel hook being positioned within the first end of the eye screw with its projection member coupled to the central swivel member, the projection member of the second swivel hook being coupled to the central swivel member; a wiffle ball being fabricated of plastic and formed in a generally spherical configuration with a plurality of circular apertures therethrough, the wiffle ball having a top including coupling means; and a rope formed in an elongated cylindrical configuration, the rope being coupled to the coupling means of the wiffle ball and secured to the second swivel hook of the swivel means, in an operative orientation a user hitting the wiffle ball thereby causing rotation of the swivel means and return of the ball.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved batting practice device with adjustable mounting means which has all the advantages of the prior art batting devices and none of the disadvantages.

It is another object of the present invention to provide a new and improved batting practice device with adjustable mounting means which may be easily and efficiently manufactured and marketed.

It is a further object of the present invention to provide a new and improved batting practice device with adjustable mounting means which is of durable and reliable construction.

An even further object of the present invention is to provide a new and improved batting practice device with adjustable mounting means which is susceptible of a low cost of manufacture with regard to both materials and labor, and which accordingly is then susceptible of low prices of sale to the consuming public, thereby making such a batting practice device with adjustable mounting means economically available to the buying public.

Still yet another object of the present invention is to provide a new and improved batting practice device with adjustable mounting means which provides in the apparatuses and methods of the prior art some of the advantages thereof, while simultaneously overcoming some of the disadvantages normally associated therewith.

Even still another object of the present invention is to provide a new and improved batting practice device with adjustable mounting means for mounting the device at a convenient location in a user's home to practice batting skills.

Lastly, it is an object of the present invention to provide a new and improved batting practice device with adjustable mounting means comprising, in combination: a support pole having an inboard end including mounting means and an outboard end including a swivel joint; the swivel joint comprising a plurality of swivel hooks with a projection member, an eye screw and a central swivel member, the eye screw having a first end formed in a generally circular configuration and a second end formed as a screw, the second end being coupled to the outboard end of the support pole, the first swivel hook being positioned within the first end of the eye screw with its projection member coupled to the central swivel member, the projection member of the second swivel hook being coupled to the central swivel member; and a wiffle ball including coupling means, a rope being coupled to the coupling means of the wiffle ball and secured to the second swivel hook of the swivel means, in an operative orientation a user hitting the wiffle ball thereby causing rotation of the swivel means and return of the ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
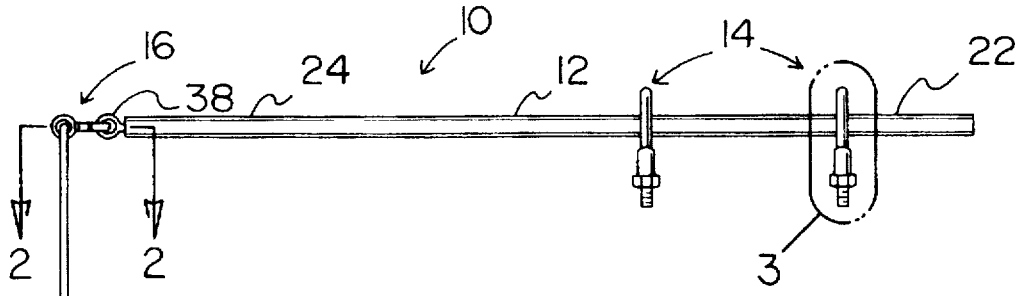
FIG. 1 is a perspective view of the preferred embodiment of the batting practice device with adjustable mounting means constructed in accordance with the principles of the present invention.

With reference now to the drawings, and in particular, to FIG. 1 thereof, the preferred embodiment of the new and improved batting practice device with adjustable mounting means embodying the principles and concepts of the present invention and generally designated by the reference number 10 will be described.

Specifically, it will be noted in the various Figures that the device relates to a new and improved batting practice device with adjustable mounting means. In its broadest context, the device consists of a support pole 12, mounting means 14, a swivel joint 16, a wiffle ball 18 and a rope 20. Such components are individually configured and correlated with respect to each other so as to attain the desired objective.

The support pole 12 is fabricated of plastic and formed in an elongated cylindrical configuration. In the preferred embodiment of the apparatus the pole is six feet long and has a diameter of ¾ inch. The support pole has an inboard end 22 which includes mounting means 14 and an outboard end 24 which includes a swivel joint 16. Note FIG. 1.

Figure 3:
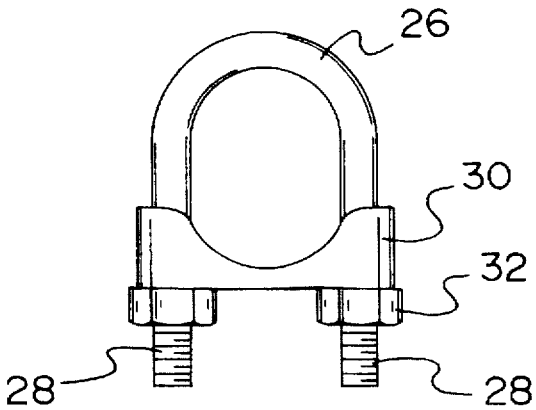
FIG. 3 discloses an enlarged perspective view of the adjustable U-clamps taken along section line 3 of FIG. 1.
Figure 4:
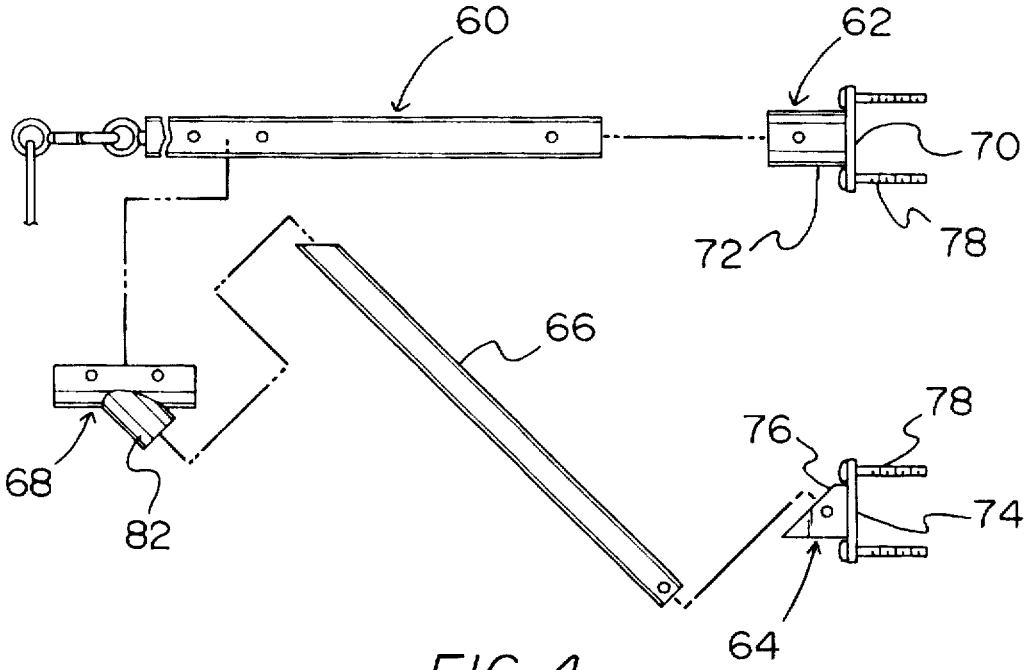
FIG. 4 discloses a perspective view of the vertical mounting hardware showing the relationship of the components to each other.
Figure 5:
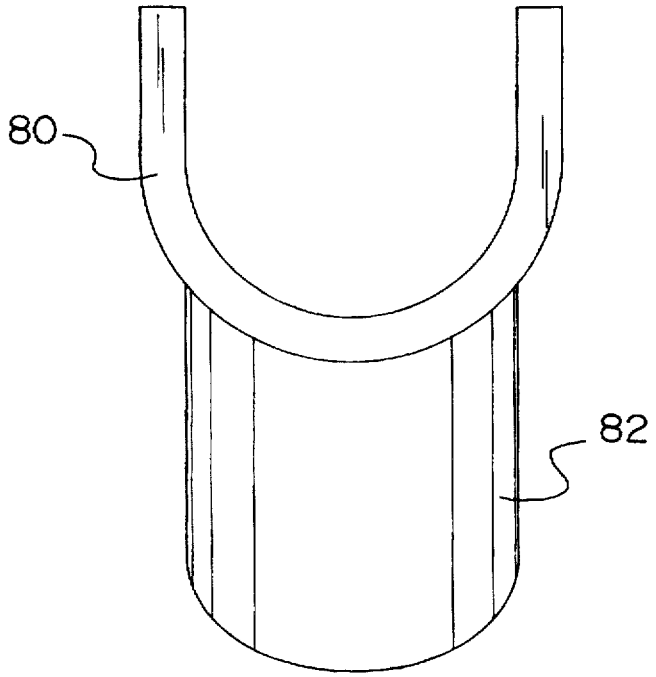
FIG. 5 is a side perspective view of the connector of the apparatus.
Figure 6:
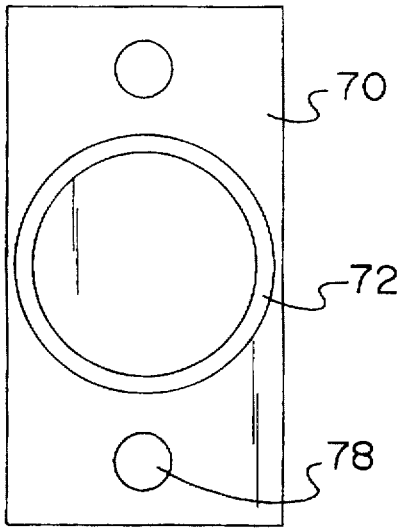
FIG. 6 is a front perspective view of the upper mounting bracket of the apparatus.
Figure 7:
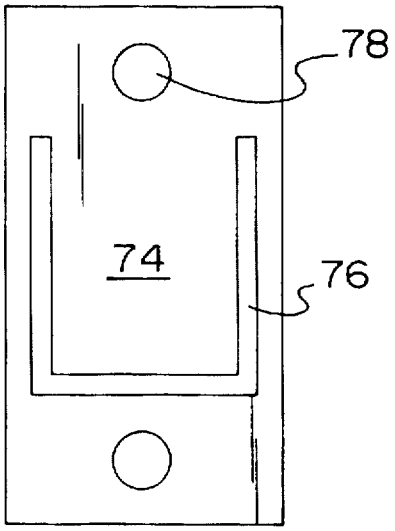
FIG. 7 is a front perspective view of the lower mounting bracket of the apparatus.

The mounting means comprises two adjustable U-clamps 26 which are each formed in a generally semi-circular configuration with two arm members formed as screws 28. Each U-clamp includes a securing member 30 coupled to the arm members by nuts 32. The U-clamps are positioned around the inboard end 22 of the support pole. In an operative orientation a user suspends the support pole from a porch ceiling joist, a overhead deck, or a permanent canopy with the U-clamps. This configuration allows a user to mount the apparatus in varying locations, at varying positions. This useful feature allows a user to practice his swing at home. Note FIGS. 1 and 3.

Figure 2:
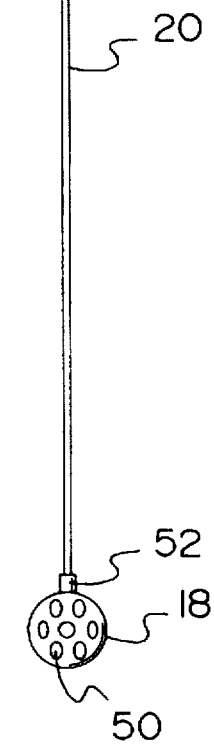
FIG. 2 discloses a cross sectional view of the swivel joint of the apparatus taken along section line 2—2 of FIG. 1.
Figure 2:
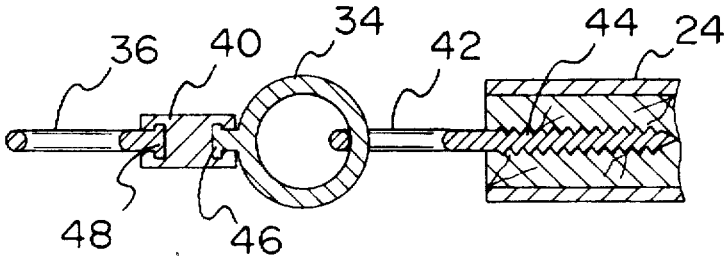

The swivel joint 16 is fabricated of metal and comprises first 34 and second 36 generally circular swivel hooks, an eye screw 38 and a central swivel member 40. The eye screw has a first end formed in a generally circular configuration 42 and a second end formed as a screw 44. The second end 44 of the eye screw is coupled to the outboard end 24 of the support pole. Note FIGS. 1 and 2.

Each swivel hook 34, 36 is formed in a generally circular configuration with a projection member 46, 48. The first swivel hook 34 is positioned within the first end 42 of the eye screw with its projection member 46 coupled to the central swivel member 40. The projection member 48 of the second swivel hook is coupled to the central swivel member 40. This configuration allows the wiffle ball and rope to rotate in a variety of directions and then return the ball to its original resting position. Note FIGS. 1 and 2.

The wiffle ball 18 is fabricated of plastic and formed in a generally spherical configuration with a plurality of circular apertures 50 through it. The apertures provide the ball with a very light weight. In alternative embodiments of the apparatus different balls such as baseballs and softballs are utilized. The wiffle ball 18 has a top which includes coupling means 52. Note FIG. 1.

The rope 20 is formed in an elongated cylindrical configuration. In the preferred embodiment of the apparatus the rope is a woven cord material ¼ inch in diameter. Varying lengths of rope can be utilized with the apparatus depending on the height of the user and the mounting location. The rope is coupled to the coupling means 52 of the wiffle ball and secured to the second swivel hook 36 of the swivel joint 16. In an operative orientation, a user hits the wiffle ball 18 thereby causing rotation of the swivel joint 16 and return of the ball to a resting position. Note FIGS. 1–3.

An alternate embodiment of the present invention is disclosed in FIGS. 4–7. In such embodiment, the mounting means comprises vertical mounting hardware 60. The vertical mounting hardware comprises a upper mounting bracket 62, a lower mounting bracket 64, a support strut 66 and a connector 68. Note FIG. 4.

The upper mounting bracket 62 has an inboard end formed as a plate 70 and an outboard end formed as a cylinder 72. The lower mounting bracket has an inboard end formed as a plate 74 and an outboard end formed as an angled cylinder 76. Each plate includes apertures and mounting bolts 78 for mounting to a wall. The upper mounting bracket 62 receives the inboard end of the support pole 22. Note FIGS. 6 and 7.

The connector 68 has a semi-cylindrical upper region 80 which is coupled to the support bar 12 and a lower region 82 which is formed in an angled cylindrical configuration. The support strut 66 is formed in an elongated cylindrical configuration and positioned between the lower mounting bracket 64 and the connector 68. The alternative embodiment of the apparatus enables a user to mount the assembly on a wall of a house, a garage, or a patio. Note FIGS. 4–7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved batting practice device with adjustable mounting means comprising, in combination:

a support pole being fabricated of plastic and formed in an elongated cylindrical configuration, the support pole having an inboard end including mounting means and an outboard end including a swivel joint, the mounting means comprising two adjustable U-clamps each formed in a generally semi-circular configuration with two arm members formed as screws, each U-clamp including a securing member coupled to the arm members by nuts, the U-clamps being positioned around the outboard end of the support pole, in an operative orientation a user suspending the support pole from a ceiling with the U-clamps;

the swivel joint being fabricated of metal and comprising first and second generally circular swivel hooks, an eye screw and a central swivel member, the eye screw having a first end formed in a generally circular configuration and a second end formed as a screw, the second end being coupled to the outboard end of the support pole, each swivel hook being formed in a generally circular configuration with a projection member, the first swivel hook being positioned within the first end of the eye screw with its projection member coupled to the central swivel member, the projection member of the second swivel hook being coupled to the central swivel member;

a wiffle ball being fabricated of plastic and formed in a generally spherical configuration with a plurality of circular apertures therethrough, the wiffle ball having a top including coupling means; and a rope formed in an elongated cylindrical configuration, the rope being coupled to the coupling means of the wiffle ball and secured to the second swivel hook of the swivel means, in an operative orientation a user hitting the wiffle ball thereby causing rotation of the swivel means and return of the ball.

2. A batting practice device with adjustable mounting means comprising, in combination:

a support pole having an inboard end including mounting means and an outboard end including a swivel joint;

the swivel joint comprising a plurality of swivel hooks with a projection member, an eye screw and a central swivel member, the eye screw having a first end formed in a generally circular configuration and a second end formed as a screw, the second end being coupled to the outboard end of the support pole, the first swivel hook being positioned within the first end of the eye screw with its projection member coupled to the central swivel member, the projection member of the second swivel hook being coupled to the central swivel member; and a ball including coupling means, a rope being coupled to the coupling means of the ball and secured to the second swivel hook of the swivel means, in an operative orientation a user hitting the ball thereby causing rotation of the swivel means and return of the ball.

3. The batting practice device with adjustable mounting means as set forth in claim 2 wherein the mounting means comprises two adjustable U-clamps each having two arm members formed as screws, each U-clamp including a securing member coupled to the arm members by nuts, the U-clamps being positioned around the outboard end of the support pole.

4. The batting practice device with adjustable mounting means as set forth in claim 2 wherein the mounting means comprises vertical mounting hardware, the vertical mounting hardware comprising a upper mounting bracket, a lower mounting bracket, a support strut and a connector, the upper mounting bracket having an inboard end formed as a plate and an outboard end formed as a cylinder, the lower mounting bracket having an inboard end formed as a plate and an outboard end formed as an angled cylinder, each plate including apertures therethrough for mounting to a wall, the upper mounting bracket receiving the inboard end of the support pole, the connector having a semi-cylindrical upper region being coupled to the support bar and a lower region formed in an angled cylindrical configuration, the support strut being formed in an elongated cylindrical configuration and positioned between the lower mounting bracket and the connector.

5. The batting practice device with adjustable mounting means as set forth in claim 2 wherein the support pole is formed in an elongated cylindrical configuration, the ball including a plurality of apertures.

6. The batting practice device with adjustable mounting means as set forth in claim 2 wherein the support pole and ball are fabricated of plastic and the swivel joint is fabricated of metal.

7. The batting practice device with adjustable mounting means as set forth in claim 2 wherein the ball is a wiffle ball.

* * * * *